US009362075B2

(12) United States Patent
Newase et al.

(10) Patent No.: US 9,362,075 B2
(45) Date of Patent: Jun. 7, 2016

(54) COVER ASSEMBLY FOR CIRCUIT BREAKER, CIRCUIT BREAKER HAVING THE SAME, AND METHOD

(71) Applicant: General Electric Company, Schenectady, NY (US)

(72) Inventors: Yatin Vilas Newase, Pune (IN); Maddela Rajesh Babu, Secunderabad (IN); Janakiraman Narayanan, Secunderabad (IN); Devendra Kumar Sharma, Secunderabad (IN)

(73) Assignee: General Electric Company, Schenectady, NY (US)

( * ) Notice: Subject to any disclaimer, the term of this patent is extended or adjusted under 35 U.S.C. 154(b) by 304 days.

(21) Appl. No.: 14/094,938

(22) Filed: Dec. 3, 2013

(65) Prior Publication Data

US 2015/0155113 A1 Jun. 4, 2015

(51) Int. Cl.

| | |
|---|---|
| ***H01H 9/02*** | (2006.01) |
| ***H01H 71/02*** | (2006.01) |
| ***H01H 71/12*** | (2006.01) |
| *H01H 71/08* | (2006.01) |

(52) U.S. Cl.

CPC ..... *H01H 71/0207* (2013.01); *H01H 71/125* (2013.01); *H01H 71/08* (2013.01); *Y10T 29/49227* (2015.01)

(58) Field of Classification Search

CPC ..... H01H 9/02; H01H 11/00

USPC ..... 361/806; 335/202; 200/293

See application file for complete search history.

(56) References Cited

U.S. PATENT DOCUMENTS

| | | | | |
|---|---|---|---|---|
| 3,784,940 | A * | 1/1974 | De Torre | H01H 83/02 335/18 |
| 4,827,231 | A * | 5/1989 | Cheski | H01H 71/04 335/17 |
| 4,975,667 | A * | 12/1990 | Morgan | H01H 71/0257 200/293 |
| 5,483,213 | A * | 1/1996 | Mueller | H01H 71/08 335/132 |
| 6,184,763 | B1 * | 2/2001 | DeGrazia | H01H 71/0264 335/172 |
| 6,205,019 | B1 | 3/2001 | Krom | |
| 6,295,190 | B1 * | 9/2001 | Rinaldi | G01R 31/3274 361/115 |
| 7,586,738 | B1 | 9/2009 | Hartzel et al. | |
| 8,519,287 | B2 | 8/2013 | Raabe et al. | |
| 2005/0109596 | A1 * | 5/2005 | Quintanilla | H01H 9/0264 200/293 |

FOREIGN PATENT DOCUMENTS

| | | |
|---|---|---|
| CN | 201117600 Y | 9/2008 |
| CN | 202231335 U | 5/2012 |

(Continued)

OTHER PUBLICATIONS

PowerWorx Advantage Series 3 RU High Current Circuit Breaker/ Fuse Power Distribution Panel; User Manual; ADCP-80-530, Issue 4; Sep. 2010; Copyright 2010, ADC Telecommunications, Inc.

*Primary Examiner* — Dion R Ferguson

*Assistant Examiner* — Mandeep S Buttar

(74) *Attorney, Agent, or Firm* — GE Global Patent Operation; Stephen G. Midgley

(57) ABSTRACT

A cover assembly for a circuit breaker includes a cover, the cover including a first portion and a second portion. The first portion is configured to at least partially cover a current sensing element within the circuit breaker, and has an interior surface and a cover opening. The second portion extends from the interior surface of the first portion, and has a terminal pocket opening aligned with the cover opening. The cover is configured to receive a load terminal through the terminal pocket opening and cover opening.

16 Claims, 6 Drawing Sheets

(56) References Cited

FOREIGN PATENT DOCUMENTS

| | | | |
|---|---|---|---|
| CN | 202434411 | U | 9/2012 |
| CN | 202564789 | U | 11/2012 |
| CN | 202737346 | U | 2/2013 |
| CN | 202888095 | U | 4/2013 |
| CN | 202888105 | U | 4/2013 |

* cited by examiner

COVER ASSEMBLY FOR CIRCUIT BREAKER, CIRCUIT BREAKER HAVING THE SAME, AND METHOD

BACKGROUND OF THE INVENTION

The subject matter disclosed herein relates to a circuit breaker having a current transformer.

Circuit breakers are widely used to protect electrical lines and equipment. The circuit breaker monitors current through an electrical conductor and "trips" to open the electrical circuit and thus interrupt current flow through the circuit provided that certain predetermined criteria are met, such as an over-current condition. An electronic trip unit ("ETU") is a device that is used in conjunction with a circuit breaker to control the current (and/or voltage) versus time trip response. The ETU is a programmable device which measures and times current flowing through the circuit breaker and initiates a trip signal when appropriate. The circuit breaker includes circuits that measure current in the device. Current-sensing transformers sense circuit current and provide current signals to the ETU for processing. Current transformers and Rogowski coils monitor the current in the circuit breaker. The current transformer is used for powering the ETU without use of external auxiliary power. The current transformer provides current output to the ETU that is proportional to the primary current flowing through it. Heat is developed due to current transformer losses. Rogowski coil is used for saturation free measurement of current in the conductor of the circuit breaker. Rogowski coil provides a voltage output that is proportional to the time derivative of the current, rather than a current output like traditional current transformers. To withstand certain impulse tests, insulating tape is pasted on the load terminal.

BRIEF DESCRIPTION OF THE INVENTION

According to one aspect of the invention, a cover assembly for a circuit breaker includes a cover, the cover including a first portion and a second portion. The first portion is configured to at least partially cover a current sensing element within the circuit breaker, and has an interior surface and a cover opening. The second portion extends from the interior surface of the first portion, and has a terminal pocket opening aligned with the cover opening. The cover is configured to receive a load terminal through the terminal pocket opening and cover opening.

According to another aspect of the invention, a circuit breaker includes at least one current sensing element, a load terminal, and a cover assembly. The cover assembly includes a cover having a first portion and a second portion. The first portion is configured to at least partially cover the at least one current sensing element within the circuit breaker, and has an interior surface and a cover opening. The second portion extends from the interior surface of the first portion, and includes a terminal pocket opening aligned with the cover opening. The load terminal is received within the second portion, through the terminal pocket opening, and through the cover opening.

According to yet another aspect of the invention, a method of insulating a load terminal from a current sensing element within a circuit breaker includes employing a cover assembly, the cover assembly having a cover including a first portion and a second portion, the first portion having an interior surface and a cover opening, and the second portion extending from the interior surface of the first portion, the second portion having a terminal pocket opening aligned with the cover opening. The method also includes installing the cover assembly on the circuit breaker by passing the terminal pocket opening of the second portion of the cover over the load terminal of the circuit breaker, and at least partially covering the current sensing element with the first portion of the cover.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
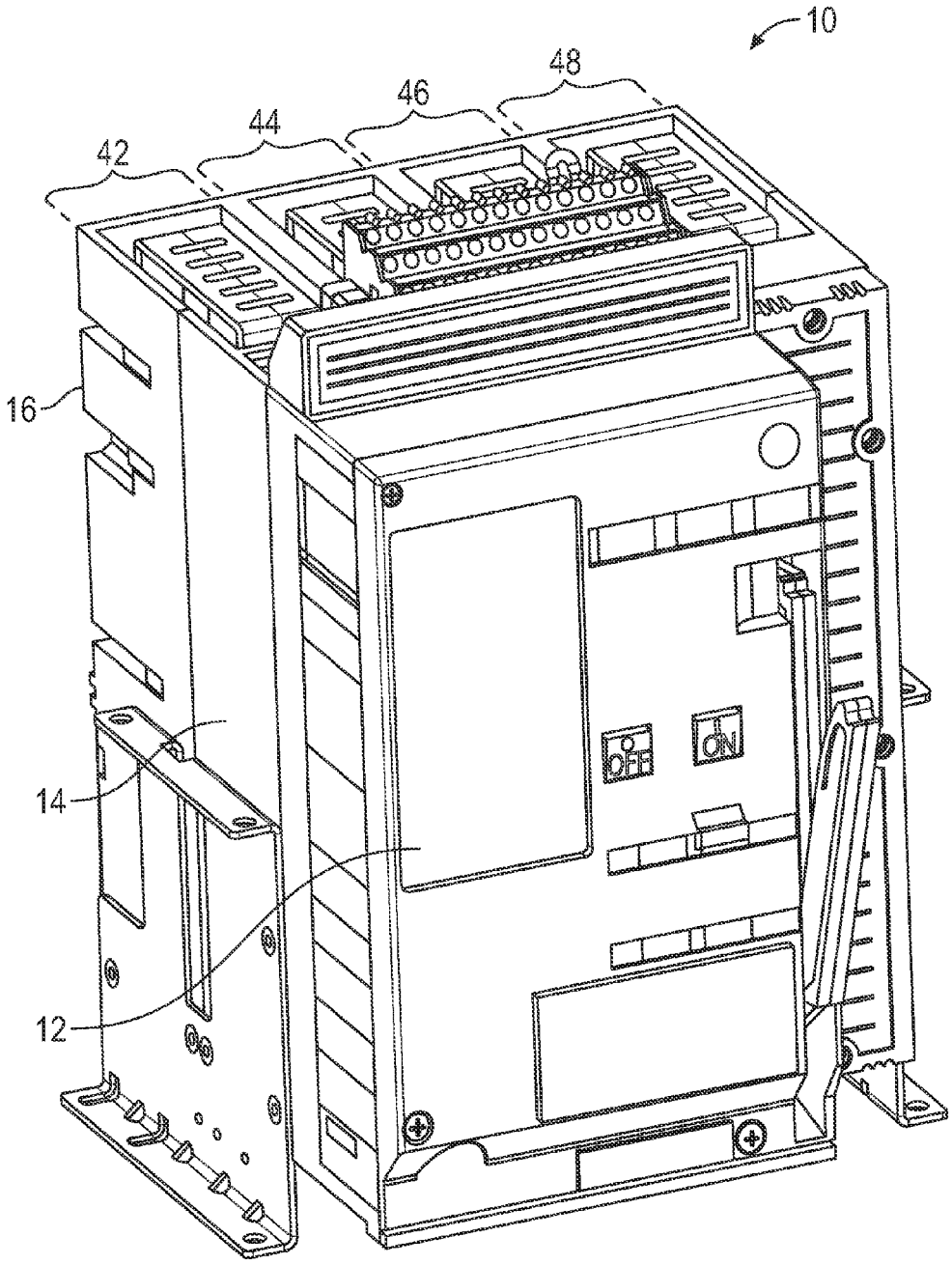
FIG. 1 is a front perspective view of an exemplary embodiment of a circuit breaker.
Figure 2:
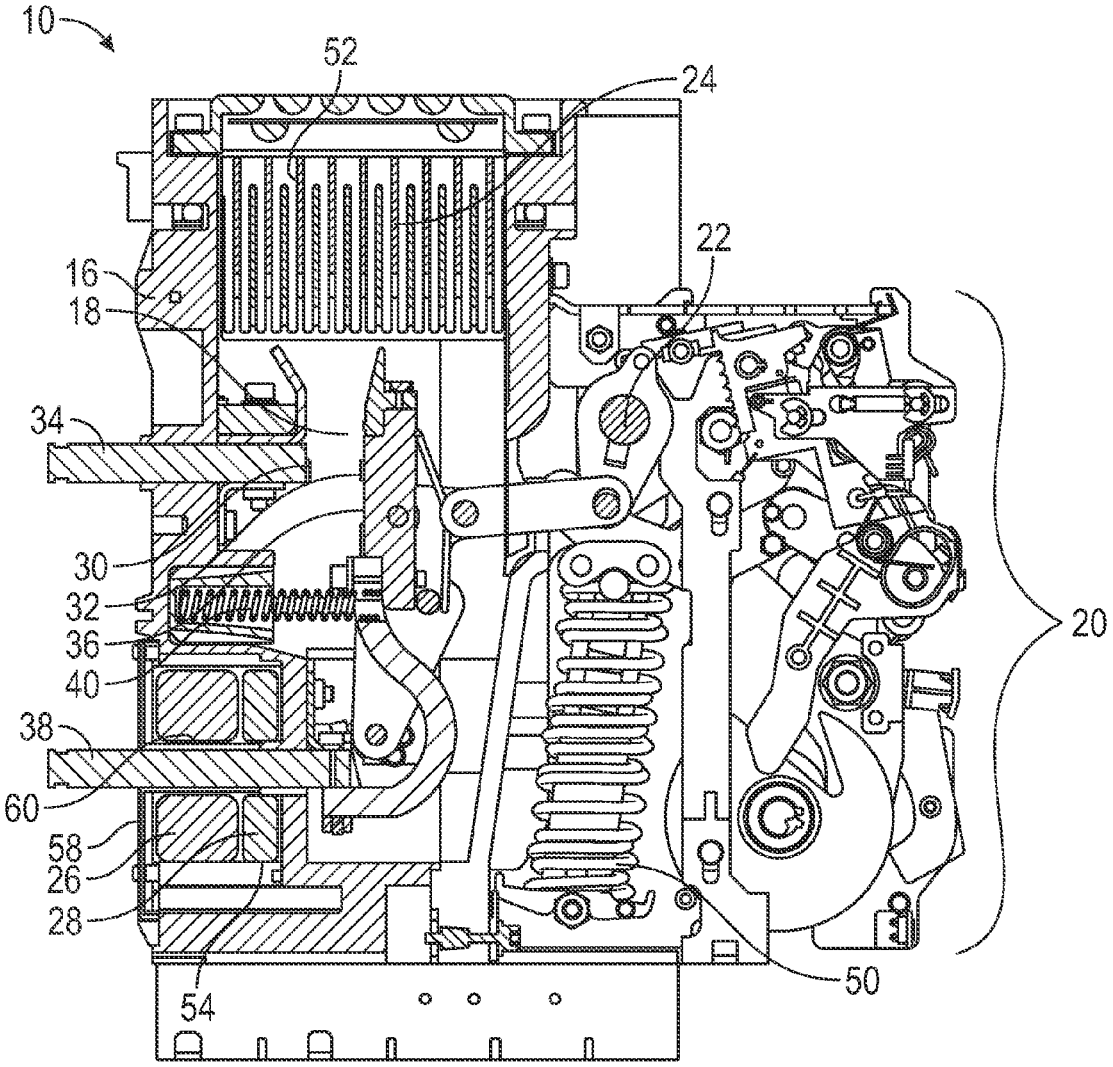
FIG. 2 is a side cross-sectional view of an exemplary embodiment of a circuit breaker with an exemplary embodiment of a cover assembly.
Figure 3:
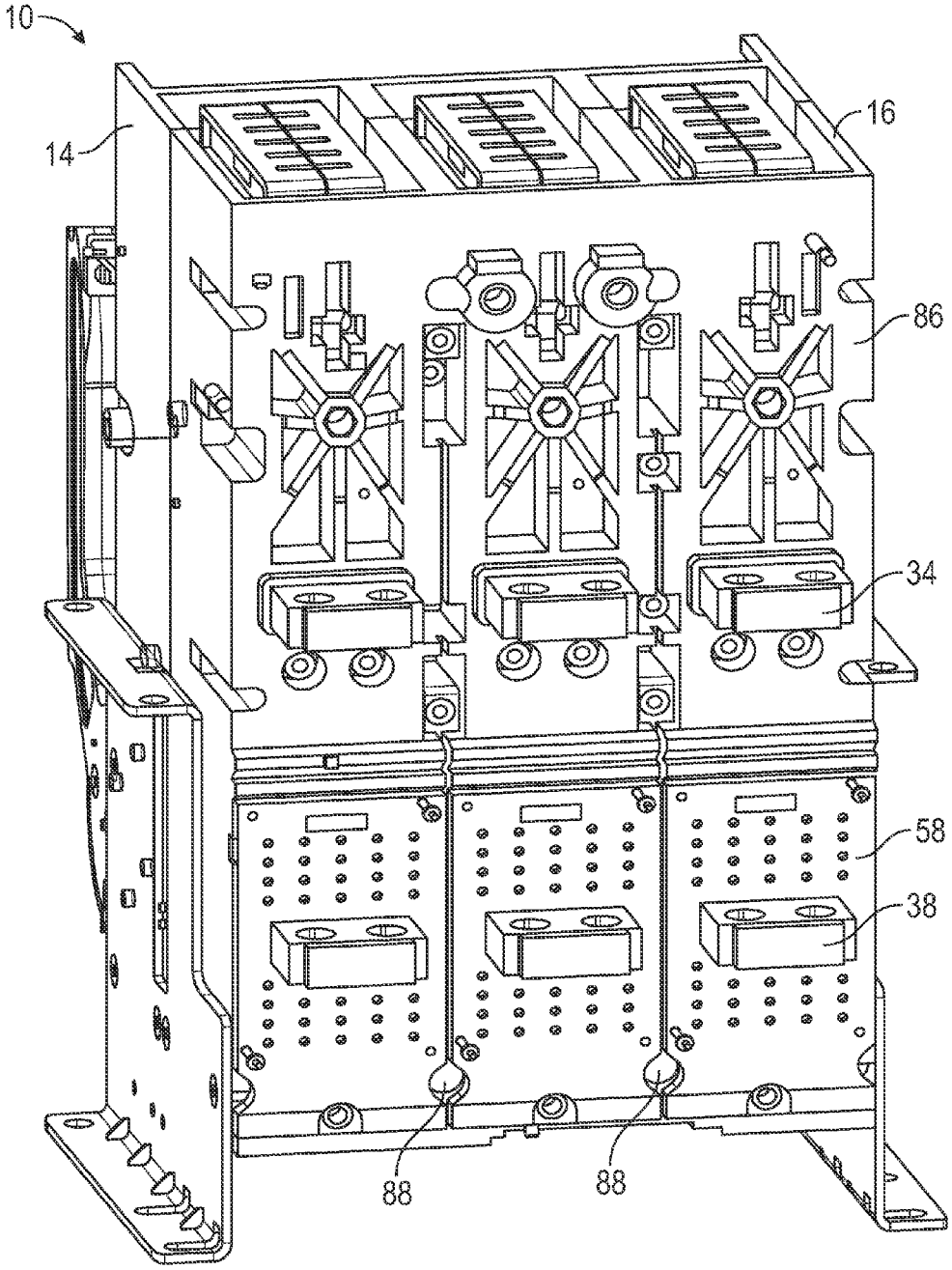
FIG. 3 is rear perspective view of an exemplary embodiment of a circuit breaker with the cover assembly.
Figure 4:
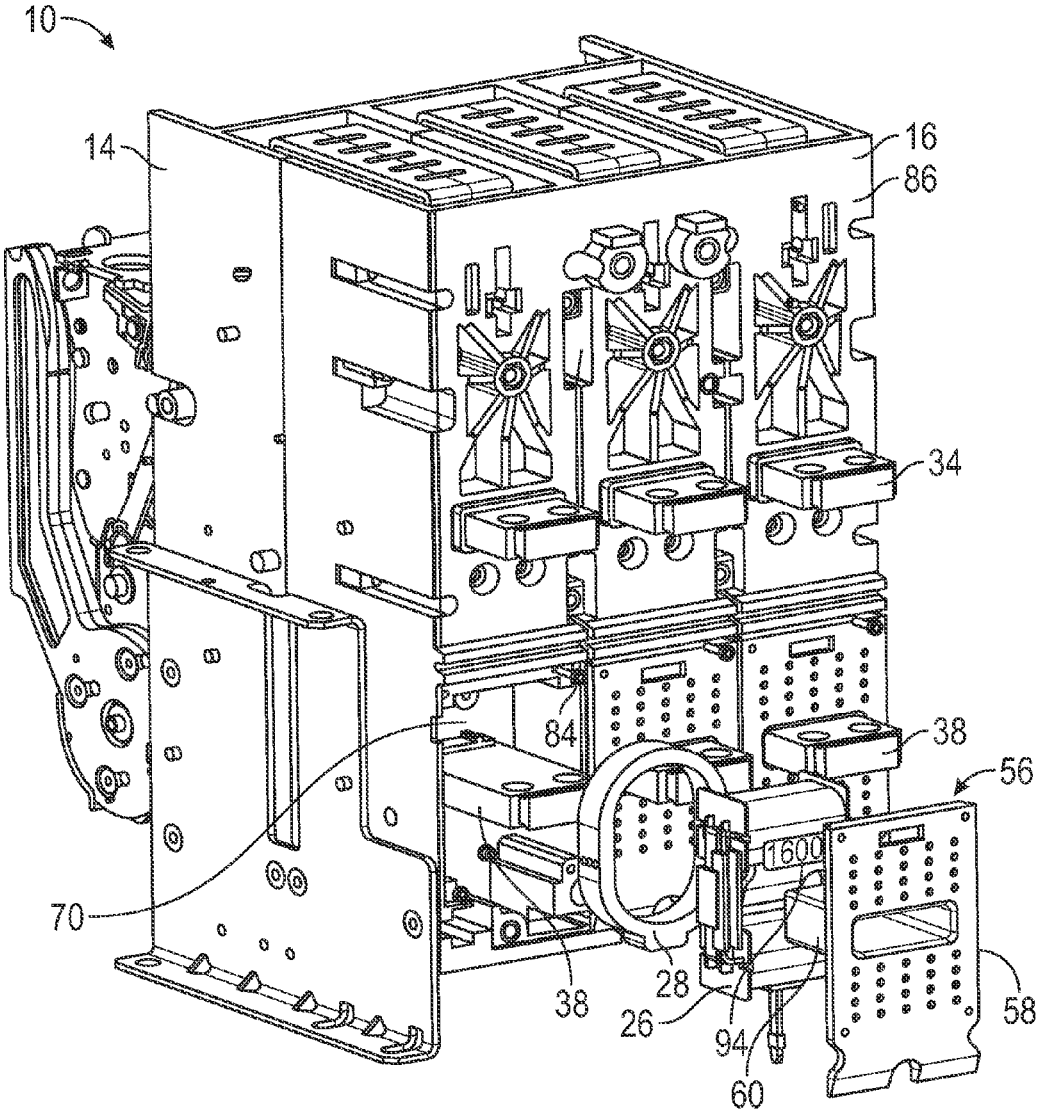
FIG. 4 is an exploded perspective view of an exemplary embodiment of the cover assembly with respect to the circuit breaker.

FIGS. 1-4 illustrate an exemplary embodiment of an electrical circuit breaker 10. The exterior perspective view of the circuit breaker 10 shown in FIG. 1 depicts an electronic trip unit ("ETU") 12, front housing 14, and rear housing 16. The circuit breaker 10 includes four phases 42, 44, 46, and 48, however alternate numbers of phases may be included in the circuit breaker 10, such as, but not limited to, three phases, as shown in FIGS. 3-4. The side cross-sectional view of the circuit breaker 10 shown in FIG. 2 depicts a contact system 18, operating mechanism 20, lay shaft 22, arc chamber 24, current transformer 26, Rogowski coil 28, line terminal 34, and load terminal 38. The contact system 18, sometimes referred to as the current path or current carrying system of the circuit breaker 10, includes fixed and moving contacts 30, 32. The fixed contact 30 is electrically connected to the line terminal 34, and the moving contact 32 is supported by a movable contact finger 36 which is electrically connected to the load terminal 38. In a normal "on" or closed condition of the circuit breaker 10, the fixed and moving contacts 30, 32 are physically connected to each other due to applied mechanical pressure on the moving contacts 32. In an "off" or open condition of the circuit breaker 10, the moving contacts 32 are separated, via opening spring 40, from the fixed contacts 30, as illustrated in FIG. 1. The contact system 18 makes or breaks the circuit based on current conditions, carries rated current without over heating, provides adequate contact pressure and depression to keep the contacts 30, 32 closed in normal conditions, provides sufficient force to open contact system 18 with desired velocity during abnormal condition, and provides dielectric isolation when contacts 30, 32 are in an open condition.

The front and rear housings 14, 16 of the circuit breaker 10 provide structural stability against short circuit forces, dielectric stability and isolation between the phases 42, 44, 46, 48, and mounting means for other subsystems within the circuit breaker 10 such as, but not limited to, the contact system 18, operating mechanism 20, and lay shaft 22.

The operating mechanism 20 serves as a storing energy device for the circuit breaker 10. The operating mechanism 20 includes an arrangement to store potential energy which is released if a switching signal is sent to the breaker 10. The potential energy can be stored in the circuit breaker 10 such as by deforming the main operating mechanism spring 50. Alternatively, potential energy is stored by compressed air, by hydraulic pressure, etc. Once this stored energy is released in the form of kinetic energy, the moving contact 32 moves since the moving contacts 32 are mechanically attached through linkages to the lay shaft 22, also referred to as a drive shaft, and then to the operating mechanism 20. The lay shaft 22 acts as a connecting member between the operating mechanism 20 and the contact system 18 and helps to transfer the motion from operating mechanism 20 to the contact system 18.

The arc chamber 24, also referred to as a quenching device or arc chute, includes a high dielectric housing material with arc plates 52 assembled substantially parallel to each other. When the moving contacts 32 open and move away from the fixed contacts 30, arc is generated. The arc is guided and wraps back and forth between the arc plates of the arc chamber 24 until it is extinguished or quenched in the arc chamber 24.

The ETU 12 includes microprocessor platforms configured to ensure reliable protections. Different protection such as overload, short circuit, and residual (ground fault) protection are possible with ETU 12, and can be programmed to accommodate different requirements. The circuit breaker 10 further includes at least one current sensing element 54, such as the current transformer 26 and the Rogowski coil 28. The current transformer 26 is used for powering the ETU 12 without use of external auxiliary power. The Rogowski coil 28 is used for saturation free measurement of current in the conductor of the circuit breaker 10. The current sensing elements 54 are required for sensing the current and then allowing the ETU 12 to provide protection. An alternating current in a conductor develops magnetic field and the interaction of this field and Rogowski coil 28 local to the field gives rise to an induced voltage within Rogowski coil 28 which is proportional to the rate of change of current being measured.

The current sensing elements 54, including the current transformer 26 and Rogowski coil 28, should not touch the load terminals 38 to avoid failure of an impulse test, such as a 12 kV impulse voltage withstand test. It has been determined herein, however, that the addition of insulating tape to the load terminal 38 accounts for variations and adds to assembly time. Such insulating tape also increases the number of parts and inventory required to manufacture and assemble the circuit breaker 10. In view of these issues, the circuit breaker 10 includes a cover assembly 56 including at least a cover 58, or sensor cap, with integrated terminal pocket 60, which serves as an insulation or isolation feature.

Figure 6:
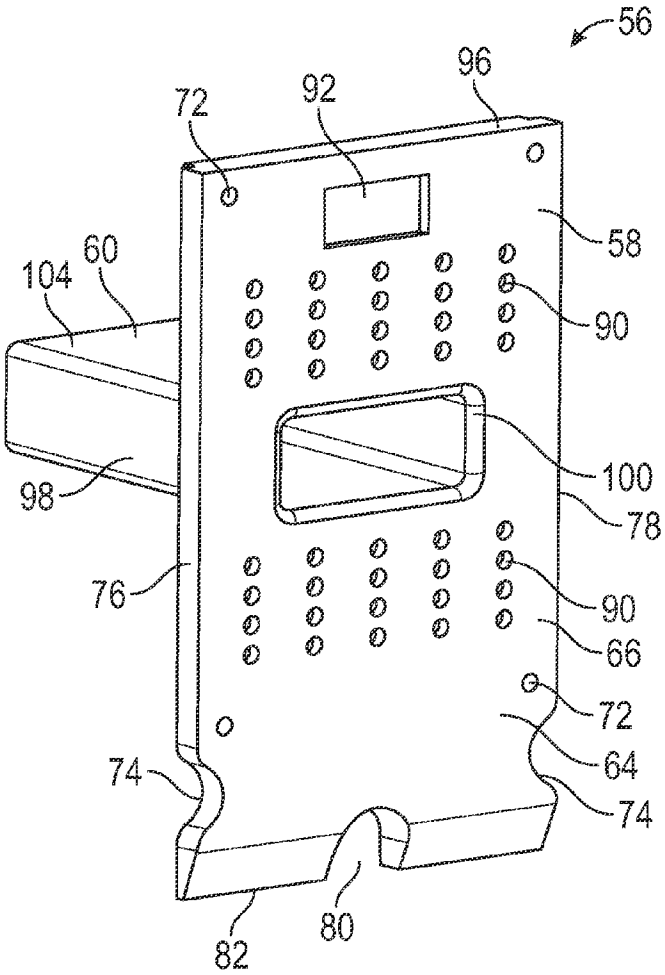
FIG. 6 is a perspective view of an exterior of the cover shown in FIG. 5.
Figure 5:
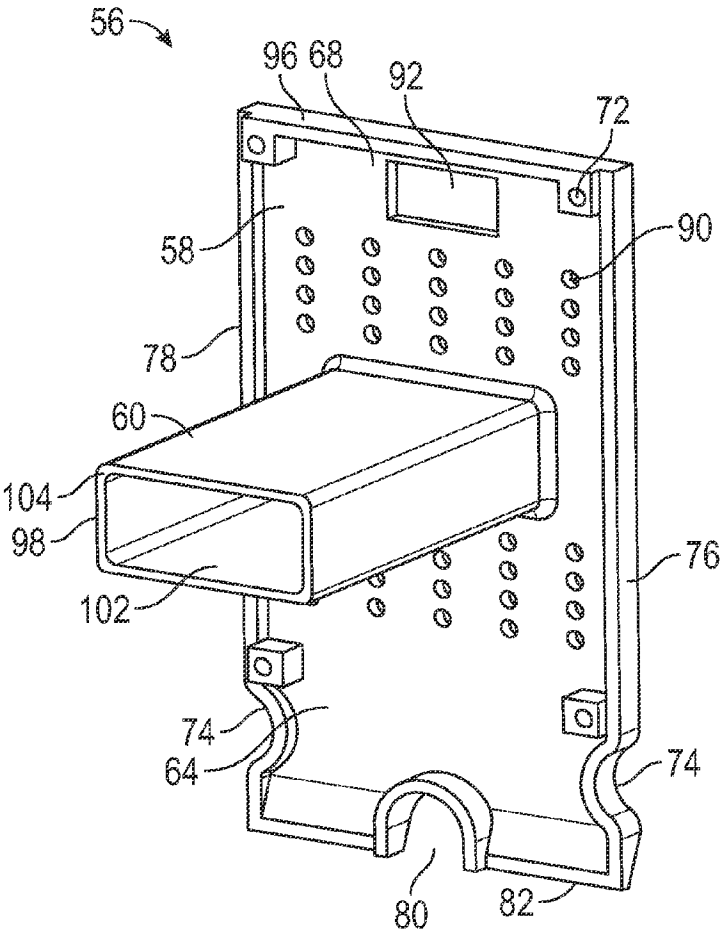
FIG. 5 is a perspective view of an exemplary embodiment of an interior of a cover for the cover assembly.
Figure 8:
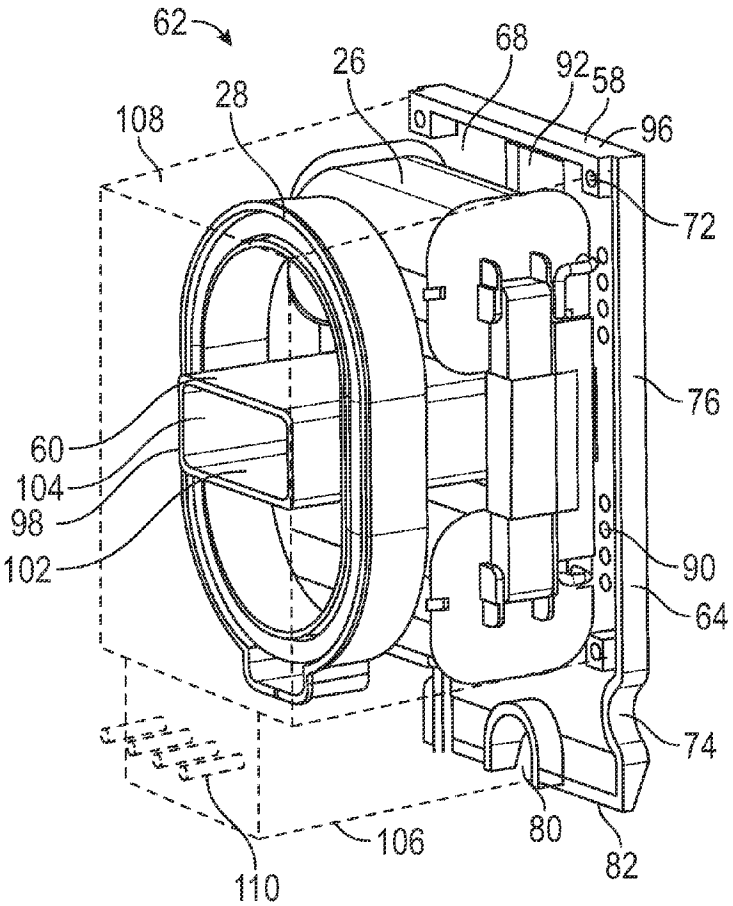
Figure 7:
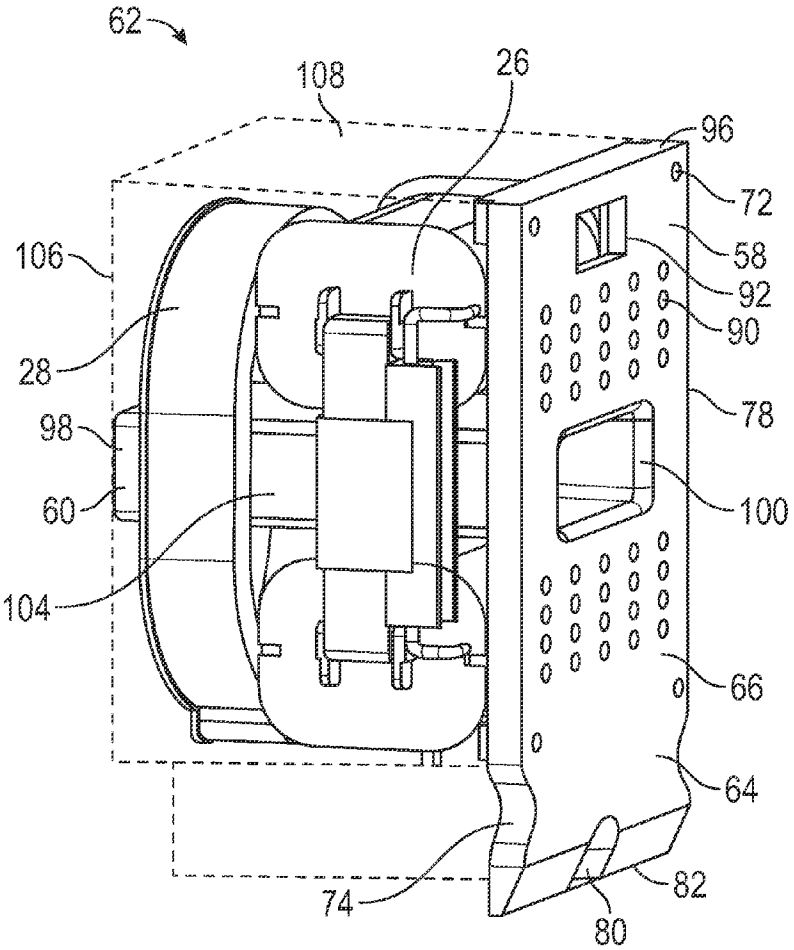
FIG. 7 a front perspective view of another exemplary embodiment of a cover assembly, with a housing shown in phantom; and, FIG. 8 is a rear perspective view of the cover assembly of FIG. 7, with the housing shown in phantom.

An exemplary embodiment of the cover assembly 56 including the cover 58 is shown in greater detail in FIGS. 5-6. FIGS. 7-8 show another exemplary embodiment of a cover assembly 62 that includes the cover 58 in addition to the current transformer 26 and Rogowski coil 28. In either embodiment of the cover assembly 56, 62, the cover 58 with integrated terminal pocket 60 avoids the impulse failure test with respect to load terminal 38 and current transformer 26, and due to space constraints within the circuit breaker 10, is sized such that the terminal pocket 60 fits between the load terminal 38 and the current transformer 26 and Rogowski coil 28.

In the illustrated embodiment of the cover 58, the cover 58 includes a first portion 64, which may be substantially planar, having an exterior surface 66 and an interior surface 68. When installed, the exterior surface 66 is exposed while the interior surface 68 faces an interior 70 (FIG. 4) of the circuit breaker 10. The first portion 64 is provided with at least one securing aperture 72 for passage of a securing member, such as a screw there through to secure the cover 58 onto the rear housing 16. The first portion 64 may further include indented sections 74 on opposing first and second sides 76, 78, as well as an indented section 80 on a third side 82, for accessing securement members within the circuit breaker 10. The third side 82 may further be tapered as shown. The cover 58 is formed of an insulative material, such as, but not limited to, thermoplastic or thermal polymer. When installed onto mating receiving apertures 84 of the rear housing 16 (see FIG. 4) the first portion 64 is arranged to be substantially flush with other cover assemblies 56, 62 assembled on the circuit breaker 10, and may additionally be substantially flush with a rear surface 86 of the rear housing 16. Indented sections 74 on adjacent first and second sides 76, 78 of the first portions 64 together form a substantially circular space 88 (FIG. 3). While the covers 58 are illustrated as separated in FIGS. 4-8, in another exemplary embodiment, any number of the covers 58 may be integrally attached with the first sides 76 attached to the second sides 78 of adjacent covers 58. For example, if the circuit breaker 10 is a three pole circuit breaker, three covers 58 may be integrally attached to each other, and if the circuit breaker 10 is a four pole circuit breaker, four covers 58 may be integrally attached.

Because the current transformer 26 gets heated during normal operation, and this local heat adds to overall heat developed by the breaker 10, venting holes 90 are provided in the first portion 64 of the cover 58 to provide ventilation to dissipate this heat. As shown, the venting holes 90 are arranged in rows and columns, and substantially evenly distributed about the first portion 64, although alternate patterns for a venting arrangement would also be within the scope of these embodiments. The first portion 64 of the cover 58 may further include a window 92 provided to view the rating 94 (FIG. 4) of the current transformer 26 to the user after assembly. The window 92 is provided in the cover 58 such that when the cover assembly 56, 62 is installed, the window 92 is aligned with and overlaps the rating 94 on the current transformer 26 so that the rating 94 is visible through the window 92. As illustrated, the window 92 is located adjacent a fourth side 96 of the first portion 64, opposite the third side 82 of the first portion 64, and substantially centrally disposed between the opposing first and second sides 76, 78, however the window 92 may be positioned wherever the rating 94 is provided on the current transformer 26.

A second portion 98 of the cover 58 includes the integrated terminal pocket 60 that extends from the interior surface 68 of the first portion 64 of the cover 58. The second portion 98 may be substantially perpendicular to the first portion 64. The terminal pocket 60 is tubular shaped, and is configured to have an interior cross-sectional shape that is slightly larger than an exterior cross-sectional shape of the load terminal 38 such that the load terminal 38 may easily pass there through. As shown, the terminal pocket 60 and the load terminal 38 may each have a substantially rectangular cross-section. The first portion 64 further includes a cover opening 100 aligned with terminal pocket opening 102 of terminal pocket 60. The cover opening 100 is illustrated as disposed substantially centrally between the first and second opposing sides 76, 78 and third and fourth opposing sides 82, 96, but may be positioned at a location most convenient for the load terminal 38 to pass there through.

When installed, the terminal pocket 60 will pass through the current transformer 26 and the Rogowski coil 28 as shown, with the current transformer 26 and the Rogowski coil 28 surrounding the outer periphery of the terminal pocket 60. The inner periphery of the terminal pocket 60 will surround the load terminal 38. Thus, the current transformer 26 and Rogowski coil 28 are separated from the load terminal 38 by a wall 104 of the terminal pocket 60. As the terminal pocket 60 forms a part of the cover 58, it is also made of an insulative material to provide isolation of the load terminal 38 from the current transformer 26 and Rogowski coil 28.

Turning to FIGS. 7-8, the cover assembly 62 is shown with the current transformer 26 and the Rogowski coil 28 disposed within a housing 106 that extends from the interior surface 68 of the first portion 64 of the cover 58. The current transformer 26 and the Rogowski coil 28 may be disposed within the housing 106 and potted therein with a potting compound 108, such as, but not limited to, an epoxy resin. The housing 106 includes connector elements 110 configured to connect the cover assembly 62 within the circuit breaker 10. The connector elements 110 may extend outwardly from the housing 106 as shown for insertion within female receptacles within the circuit breaker 10. Alternatively, the connector elements 110 may include female receptacles configured to receive male connectors of the circuit breaker 10, or may include a combination of female receptacles and male connectors. In any case, the cover assembly 62 with cover 58, housing 106, current transformer 26 and Rogowski coil 28 is employable as an integral unit for insertion into, or removal from, the circuit breaker 10. In yet another exemplary embodiment, a current sensing structure having a housing with current transformer 26 and Rogowski coil 28 contained therein may be positionable onto the cover 58 of the cover assembly 56 of FIGS. 5-6, with the terminal pocket 60 threaded into an aperture in the housing of the current sensing structure, to arrive at the cover assembly 62 of FIGS. 7-8 to subsequently employ the cover assembly 62 as an integral unit. Also, while the above-described embodiments have been described as including both the current transformer 26 and the Rogowski coil 28, in alternate embodiments, only one of the current transformer 26 and Rogowski coil 28 is included in either the circuit breaker 10 or the integrated cover assembly 62.

By providing the cover assembly 56, 62 with the load terminal pocket 60 as described within the exemplary embodiments of the cover assembly 56, 62, some advantages that may be realized in the practice of some embodiments include the simplified assembly of the cover assembly 56, 62 with the circuit breaker 10 by eliminating the need to separately install insulating tape on the load terminal 38. Fewer parts are required, which additionally reduces inventory requirements. Additionally, because the cover assembly 56, 62 is pre-formed with the load terminal pocket 60, variations that may be experienced with insulating tape are eliminated. When the cover assembly 62 includes the current transformer 26 and Rogowski coil 28 together as an integral unit, further advantages including efficiency and simplicity are realized.

The use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A cover assembly for a circuit breaker, the cover assembly comprising:

a cover, the cover including:

a first portion configured to at least partially cover a current sensing element within the circuit breaker, the first portion having an interior surface and a cover opening; and, a second portion extending from the interior surface of the first portion, the second portion having a terminal pocket opening aligned with the cover opening;

wherein the cover is configured to receive a load terminal through the terminal pocket opening and cover opening;

at least one current sensing element surrounding the second portion; and a housing extending from the interior surface of the first portion of the cover, the at least one current sensing element disposed within the housing.

2. The cover assembly of claim 1, wherein the first portion further includes a plurality of venting holes arranged to dissipate heat from the current sensing element therethrough.

3. The cover assembly of claim 1, wherein the first portion further comprises a viewing window, the viewing window configured to align with a rating provided on the current sensing element.

4. The cover assembly of claim 1, wherein the second portion is substantially perpendicular to the first portion.

5. The cover assembly of claim 1, wherein the first portion is substantially planar and the second portion is tubular.

6. The cover assembly of claim 5, wherein the second portion has a substantially rectangular cross-sectional shape.

7. The cover assembly of claim 1, wherein the at least one current sensing element includes a current transformer.

8. The cover assembly of claim 1, wherein the at least one current sensing element includes a Rogowski coil.

9. The cover assembly of claim 1, wherein the at least one current sensing element is disposed within the housing.

10. The cover assembly of claim 1, wherein the housing further comprises a connector element disposed thereon and configured to connect the cover assembly within the circuit breaker.

11. A circuit breaker comprising:

at least one current sensing element;

a load terminal; and, a cover assembly, the cover assembly having a cover formed of an insulative material including:

a first portion configured to at least partially cover the at least one current sensing element within the circuit breaker, the first portion having an interior surface and a cover opening; and, a second portion extending from the interior surface of the first portion, the second portion having a terminal pocket opening aligned with the cover opening;

wherein the load terminal is received within the second portion, through the terminal pocket opening, and through the cover opening;

wherein the current sensing element is isolated from the load terminal by the second portion; and wherein the cover assembly further includes a housing extending from the interior surface of the first portion, the current sensing unit is disposed within the housing, and the cover assembly and current transformer are insertable as an integral unit within the circuit breaker.

12. The circuit breaker of claim 11, wherein the at least one current sensing element includes a current transformer.

13. The circuit breaker of claim 12, wherein the current transformer includes a rating provided on the current transformer, the first portion includes a window, and the rating is visible through the window.

14. The circuit breaker of claim 12, wherein the first portion includes a plurality of venting holes, the venting holes arranged to dissipate heat from the current transformer therethrough.

15. A method of insulating a load terminal from a current sensing element within a circuit breaker, the method comprising:

employing a cover assembly, the cover assembly having a cover including a first portion, the first portion having an interior surface and a cover opening, and a second portion extending from the interior surface of the first portion, the second portion having a terminal pocket opening aligned with the cover opening;

installing the cover assembly on the circuit breaker by passing the terminal pocket opening of the second portion of the cover over the load terminal of the circuit breaker; and, at least partially covering the current sensing element with the first portion of the cover, wherein the cover assembly includes the current sensing element and installing the cover assembly includes simultaneously installing the current sensing element and cover onto the circuit breaker.

16. The method of claim 15, further comprising dissipating heat from the current transformer through venting holes in the first portion of the cover of the cover assembly.

* * * * *